United States Patent [19]

Hector

[11] Patent Number: 4,972,614

[45] Date of Patent: Nov. 27, 1990

[54] ROTATABLE SIGN CARRYING DEVICE

[76] Inventor: Francis N. Hector, P.O. Box 81024, Las Vegas, Nev. 89180

[21] Appl. No.: 417,584

[22] Filed: Oct. 5, 1989

Related U.S. Application Data

[63] Continuation-in-part of Ser. No. 349,316, May 8, 1989, Pat. No. 4,910,878, which is a continuation of Ser. No. 54,277, May 26, 1987, abandoned.

[51] Int. Cl.[5] ..... G09F 11/02

[52] U.S. Cl. ..... 40/479; 40/608

[58] Field of Search ..... 40/473, 479, 602, 608, 40/493, 412, 439, 422, 440, 477

[56] References Cited

U.S. PATENT DOCUMENTS

| | | | |
|---|---|---|---|
| 622,115 | 3/1899 | Carlson | 40/479 |
| 1,532,575 | 4/1925 | Camden | 40/479 |
| 1,571,790 | 2/1926 | Camden | 40/479 |
| 1,750,118 | 3/1930 | Mueller, Jr. et al. | 40/602 |
| 1,825,564 | 9/1931 | Whitlow | 40/479 |
| 1,856,349 | 5/1932 | Bigelow | 40/602 |
| 2,417,122 | 3/1947 | Pearson | 40/479 |
| 4,365,435 | 12/1982 | Snyder, Jr. | 40/602 |
| 4,503,631 | 3/1985 | Kelly | 40/602 |

FOREIGN PATENT DOCUMENTS

| | | | |
|---|---|---|---|
| 139858 | 5/1985 | European Pat. Off. | 40/602 |

*Primary Examiner*—John Weiss
*Assistant Examiner*—Michael Lynch
*Attorney, Agent, or Firm*—George A. Bode; D. Neil LaHaye

[57] ABSTRACT

A sign carrying device. A cylindrical base section vertically mounted in a footing has an upper cylindrical section extending upwardly therefrom. A first collar extends radially outwardly between the sections for rotatably receiving a sign carrying support structure. The support structure is formed from two (2) frame members connected together by horizontal supports, one of which is connected to a second collar which is rotatably received on the first collar by providing bearings therebetween. A pulley rotatably mounted in the upper cylindrical section and dual pulleys mounted on a brace extending from the upper cylindrical section have a cable threaded over and therethrough respectively. One end of the cable is rigidly attached to the sign carrying support structure and the other end is attached to a counterweight suspended inside the axially-aligned bores of the cylindrical base section and the upper cylindrical section. This allows rotation of the support structure in response to wind pressure thereon, but returns the support structure to its first or normal position upon cessation or reduction of the wind to a predetermined torque component.

11 Claims, 2 Drawing Sheets

ROTATABLE SIGN CARRYING DEVICE

This application is a continuation-in-part application of a previous application by the same inventor bearing U.S. Ser. No. 07/349,316 filed May 8, 1989 (now U.S. Pat. No. 4,910,898 ) which was a continuation of U.S. Ser. No. 07/054,277 filed May 26, 1987, now abandoned. The entire previous applications, Ser. Nos. 07/054,277 and 07/349,316, are incorporated herein by reference as if set forth in full below.

BACKGROUND OF THE INVENTION

1. Field of the Invention

The present invention is generally related to outdoor advertising structures and, more particularly, to such a rotatable structure.

2. General Background

Outdoor structures such as billboards or signs used for advertising or as information or warning signs are used in a variety of locations such as on the tops of buildings, along roadsides, and at construction sites. Such structures are constantly subjected to wind from varying directions and of greatly varying velocities. Such varying conditions have necessitated that many structures be provided with substantial reinforcement to prevent damage to the structure by high velocity winds. This results in bulky structures which are expensive to manufacture and maintain. Applicant is aware of the following outdoor structures which have attempted to address similar problems.

U.S. Pat. No. 3,321,160 issued to Turnbull entitled "Rotatable Pole Base Construction" discloses a base contruction for a pole permitting relative rotation between the pole and the pole foundation so that an arm mounted on an upper portion of the pole may be swung to a different position.

U.S. Pat. No. 3,645,057 issued to Kaplan entitled "Base For Mounting A Traffic Light Pole In Rotatable And Vertically Adjustable Relation" discloses the combination of projecting pole flanges and opposing supporting and clamping members adjustable over the anchor bolts.

U.S. Pat. No. 3,521,390 issued to Carlson entitled "Signboard Wind Load Limiting Apparatus" discloses an apparatus for protecting signboards from wind damage and allowing the use of supporting columns consisting of a signboard frame having a pivot upon which one or more signboard panels are mounted for movement on an axis located closer to one side of the panel than the other and a releasable load limiting lock connected between the panel and the framework for normally holding the panel in a fixed position and for releasing the signboard when the wind loading exceeds a predetermined value.

U.S. Pat. No. 4,503,631 issued to Kelly entitled "Blow-Through Pivotal Sign" discloses a signboard attached to a support structure to allow the signboard to rotate along a horizontal or vertical axis and a mechanism for retaining the signboard in a fixed position until a preselected torque due to wind load is applied, as well as a wind responsive retractor for retracting the retaining mechanism to prevent damage thereto after the signboard has been deflected from the fixed position and is swinging freely.

U.S. Pat. Nos. 2,454,648 issued to Green; 4,544,125 issued to Seeley; 3,899,843 issued to Doyle, et al. and 2,048,818 issued to Neil disclose the use of springs that give way in the wind to prevent damage to the sign.

U.S. Pat. Nos. 3,638,341 issued to Holmes and 1,242,429 issued to Enochty disclose the use of wind spillways to allow the wind to pass through the sign.

Applicant's own rotatable sign carying device (Ser. No. 07/349,316, now U.S. Pat. No. 4,910,898, discloses a rotatable superstructure with panel pivotally mounted therein and responsive to wind pressure applied on their surfaces.

SUMMARY OF THE INVENTION

The present invention solves the aforementioned problems in a simple and straightforward manner. What is provided is a signboard having a cylindrical base section mounted in a footing. An upper cylindrical section is rigidly attached to the base section by a circular collar. A sign carrying support structure is provided with a similar collar that fits over the upper cylindrical section and rests on the circular collar of the upper cylindrical section. Bearings that fit between and are received in annular grooves in the collars allow rotation of the support structure relative to the base and upper cylindrical section. The support structure provides at least two (2) surfaces to which signs are mounted for display. A weight and pulley system attached to the support structure and upper cylindrical section allows rotation of the support structure in response to wind pressure against the sign surfaces to prevent damage and returns the support structure to its original position upon reduction or cessation of the wind pressure.

BRIEF DESCRIPTION OF THE DRAWINGS

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
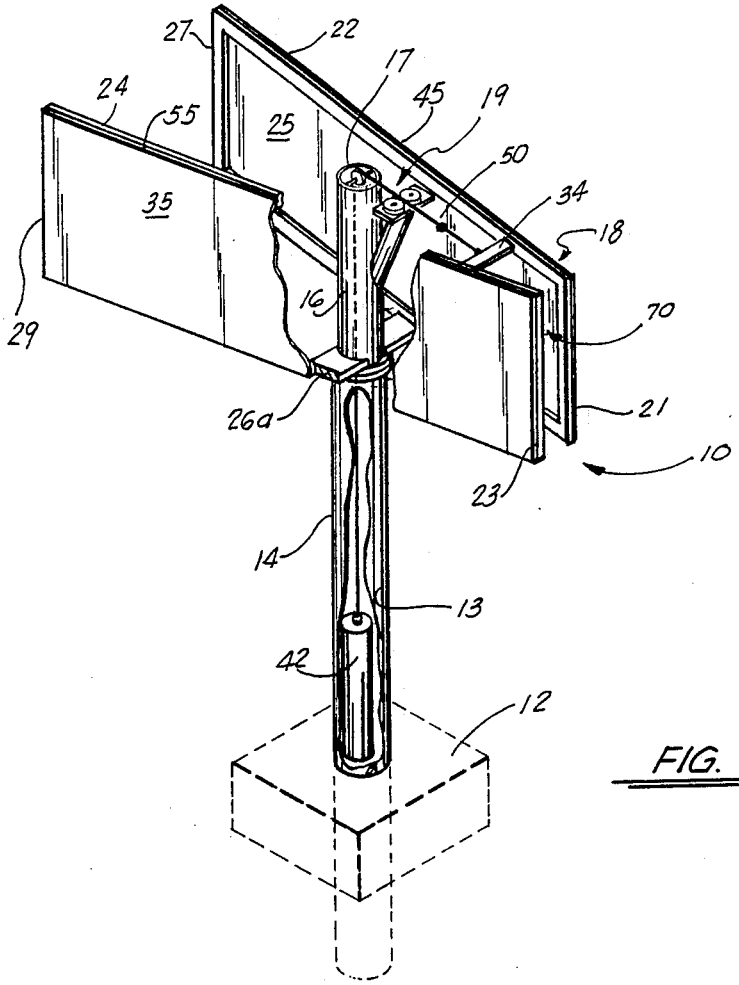
FIG. 1 is a perspective view of the preferred embodiment apparatus of the present invention with a section of one sign panel broken away.

Referring now to the drawings, it is best seen in FIG. 1 that the preferred embodiment apparatus of the present invention is generally referred to by the numeral 10. Sign carrying device 10 is generally comprised of footing 12, cylindrical base or support section 14, cylindrical upper section 16, sign carrying support structure 18, and means 19 for allowing rotation of support structure 18 in response to wind pressure and returning it to its original position upon cessation or reduction of wind pressure to a predetermined component.

Footing 12, best seen in FIG. 1 (in phantom) is illustrated as being square, but may be of any suitable shape, such as rectangular, to suit the terrain or area where sign carrying device 10 is placed. In the preferred embodiment, footing 12 is constructed from a suitable heavy material such as concrete to prevent sign carrying device 10 from being tipped over during extremely windy conditions.

Figure 2:
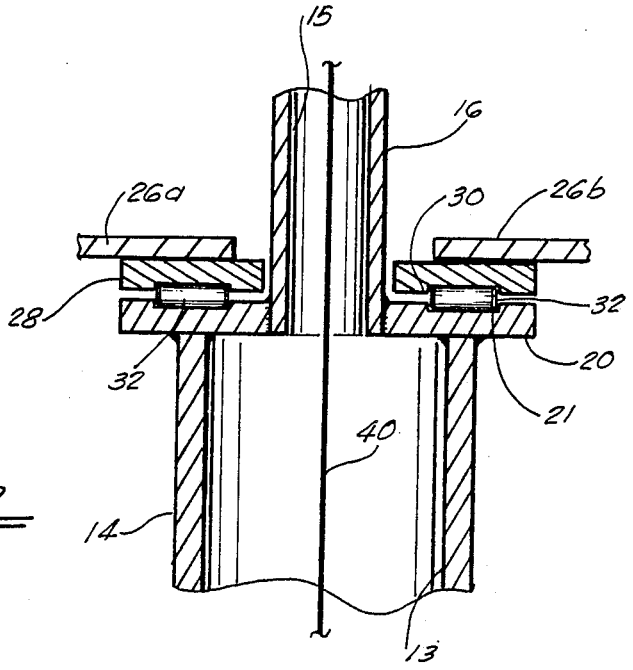
FIG. 2 is a detailed cross-sectional view of the rotatable mounting of the upper section on the support structure of the embodiment of FIG. 1.
Figure 3:
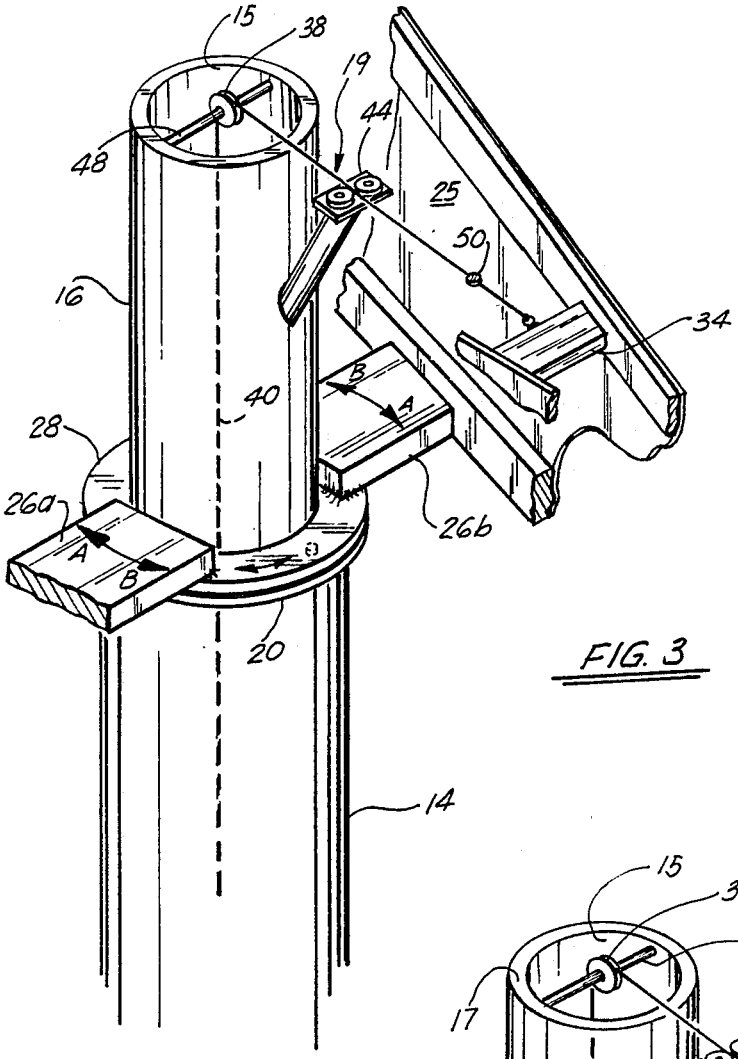
FIG. 3 is a detailed view of the pulley system of the embodiment of FIG. 1; and, FIG. 4 is a detailed view of the pulley system of the embodiment of FIG. 1 illustrating its operation and allowance for rotation of the support structure.

Cylindrical base or support section 14 is rigidly mounted in footing 12 by any conventional means such as casting the wet concrete around cylindrical base section 14. As seen in FIG. 1, cylindrical base section 14 may be positioned to extend below footing 12 into the ground (in phantom) to provide increased stability. Cylindrical base section 14 is hollow and, as best seen in FIGS. 2 and 3, provided with first circular collar 20 which extends radially around the upper end thereof. Collar 20 may be formed as an integral part of base section 14 or may be a separate piece attached to base section 14 by any conventional means such as welding. Collar 20 is provided with an annular groove 21 on its upper side for receiving bearings.

As best seen in FIGS. 2 and 3, cylindrical upper section 16 is smaller in diameter than cylindrical base section 14 and extends upwardly from first collar 20 in axial alignment with section 14. Cylindrical upper section 16 is hollow and, as best illustrated in FIGURE 2, may be formed as an integral part of collar 20 and base section 14 or may be attached thereto by any suitable means such as welding.

As best seen in FIGS. 1–3, sign carrying support structure 18 is slidably and rotatably received over cylindrical upper section 16. Support structure 18 is formed from generally rectangular first and second frame members 22, 24 having proximate and distal ends 21, 23 and 27, 29, respectively. Frame members 22, 24 are connected together at two (2) areas beyond their mid-point, or nearer the proximate ends 21, 23, and, are increasingly divergent longitudinally therealong toward the distal ends 27, 29. The areas of connection are at the lower edge of each of frame members 22, 24 and interior thereof. The connections are formed by two (2) first horizontal supports **26*a*, 26*b*, each of which are rigidly attached interiorly to frame members 22, 24 and extend therebetween an equal distance to second collar 28. As best seen in FIGS. 1–3, each horizontal support 26 is rigidly attached at its underside to the upper surface of second collar 28. Second collar 28 is provided with an annular groove 30, for receiving bearings, opposing and mating with annular groove 21 in first collar 20 for receiving bearings 32. This enables rotation of collar 28 and, therefore, support structure 18 relative to collar 20 with a minimum of resistance. The second areas of connection of frame members 22, 24 are on the upper interior edge of frame members 22, 24 somewhat nearer the proximate ends 21, 23 than the first areas of connection and are formed from a single second horizontal support member 34 that extends between and is rigidly connected to frame members 22, 24 interiorly thereof. Frame members 22, 24 are illustrated in FIG. 1 as having panels 25, 35 respectively attached thereto to which display signs may be applied. Panels 25, 35 may also be omitted and replaced with previously prepared sign panels. It should be noted that in the installed position the upper edges 45, 55 of frame members 22, 24 are positioned slightly below the upper end 17 of cylindrical upper section 16** for reasons to be explained hereinbelow.

Figure 4:
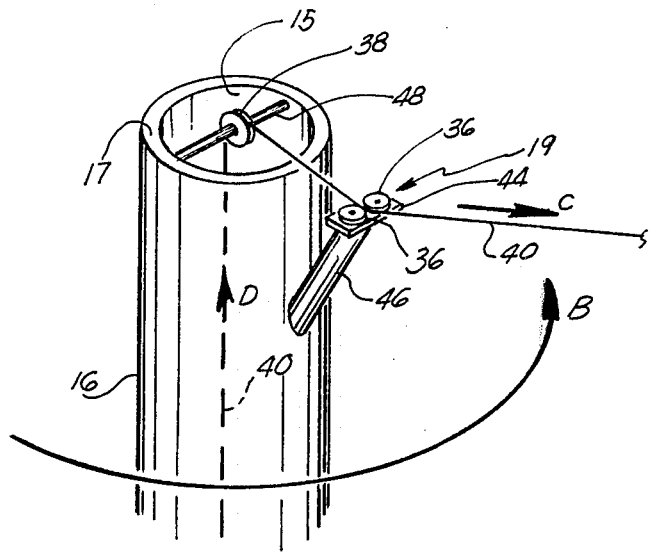

Means 19 for allowing rotation of sign carrying support structure 18 in response to wind pressure thereon and for returning support structure 18 to its first, normal position (FIG. 1) upon reduction or cessation of such wind pressure to a pre-determed torque component is illustrated in its entirety in FIG. 1 and in details thereof in FIGS. 3 and 4. Means 19 is formed from dual pulleys 36, single pulley 38, cable 40, connection of cable 40 at one end to the support structure 18 at support member 34 and connection of cable 40 to counterweight 42. Dual pulleys 36 are rotatable mounted on horizontal plate 44 so as to rotate about a vertical axis. Plate 44 is rigidly mounted on brace 46 which is attached at its lower end to cylindrical upper section 16 and extends upwardly at an angle away therefrom. Brace 46 is of a length such that dual pulleys 36 are at a level slightly above the upper edge 17 of cylindrical upper section 16 and above the upper edges 45, 55 of frame members 22 and 24. Single pulley 38 is rotatably mounted on pin or axle 48 which is rigidly horizontally mounted across the inner diameter of bore 15 of cylindrical upper section 16. Counterweight 42 is suspended at the lower or distal end of cable 40 inside the bore 13 of cylindrical base section 14 with the opposite end or upper or proximate end of cable 40 being rigidly attached to second horizontal support member 34 by any suitable means, such as being secured to an eye bolt. Thus cable 40 is secured to member 34 at its proximate end, passes through pulley means 36 and 38 in a horizontal orientation and at pulley 38 turns vertical and passes through bores 15, 13 where it is secured to counterweight 42 at its distal end. Cable 40 may also be provided with predetermined weak point 50, commonly known as a fuse link, as best seen in FIG. 3.

In operation, footing 12 and sections 14 and 16 are located as a single unit in a suitable commercial area. Sign carrying support structure 18 with display signs (not shown) on panels 25, 35, is installed by sliding second collar 28 over cylindrical upper section 16 until it rests upon first collar 20. Bearings 32 fit in mating annular grooves 21 and 30 to allow rotation of second collar 28, and therefore, support structure 18, in response to wind pressure on the surface area of panels 25. Counterweight 42, the amount which is pre-determined according to the surface area of panels 25, is suspending inside cylindrical base section 14 on the distal end of cable 40 which has its opposite or proximate end attached to second horizontal support 34 and is threaded over pulley 38 and between dual pulleys 36. In this manner, weight 42 provides tension on cable 40 that maintains support structure 18 in the first or normal position of FIG. 1 and substantially in alignment with pulleys 36 and 38. However, support structure 18 is allowed to rotate relative to base section 14 by means of first and second collars 20, 28 in response to wind pressure on the surfaces of panels 25, 35 to prevent damage to sign carrying device 10 with counterweight 42 acting as a drag on such rotational movement as counterweight 42 constantly biases structure 18 to its first position. Upon cessation or sufficient reduction of wind pressure to a predetermined torque component, counterweight 42 provides sufficient force or tension on cable 40 to return support structure 18 to its first or normal position,, that of FIG. 1. ARROWS C and D in FIG. 4 illustrate the upward and outward movement of cable 40 against counterweight 42 in response to rotation by support structure 18 in either the clockwise or counter-clockwise directions of ARROWS A and B. This rotation is constantly opposed by counterweight 42 urging cable 40 downward (opposite ARROWS C and D) to is first or normal position of FIG. 1. The positioning of the upper edges 45, 55 of frame members 22, 24 below the upper edge 17 of upper section 16 and dual pulleys 36 prevents the interference of frame members 22, 24 with cable 40 during rotation in response to wind pressure on panels 25. The use of dual pulleys 36 allows rotation is either clockwise or counter-clockwise direction (ARROWS A or B). A space 70, best seen in FIG. 1, is left between the proximate ends 21, 23 of frame members 22, 24 so that any wind from the direction of distal ends 27, 29 may flow through with a minimum of pressure on panels 25. Pre-determined weak point or fuse link 50 in cable 40 allows breaking of cable 40 in the event that second collar 28 does not rotate properly or excessive pressure is placed on cable 40 as a result of very high winds.

As an alternate embodiment, frame members 22, 24 may be positioned parallel to each other or additional sides may also be added.

Because many varying and different embodiments may be made within the scope of the inventive concept herein taught and because many modifications may be made in the embodiment herein detailed in accordance with the descriptive requirement of the law, it is to be understood that the details herein are to be interpretated as illustrative and not in a limiting sense.

What is claimed as invention is:

1. A sign carrying device, comprising:

(a) a base section mounted in a footing;

(b) an upper section connected to and extending from said base section;

(c) a first collar means mounted on and extending radially outwardly from the connection of said base and upper sections;

(d) a sign carrying support structure rotatably received on said first collar; and, (e) means for allowing rotation of said support structure from a first position in response to wind load thereon and for biasing said structure to return to said first position upon reduction of said wind load to a pre-determined torque component, wherein said means for allowing rotation comprises:

i. a brace member attached to said upper section and extending outwardly therefrom;

ii. first pulley means rotatably mounted on said brace member;

iii. second pulley means rotatably mounted inside a bore provided longitudinally through said upper section said second pulley means being positioned adjacent the top of said upper section;

iv. cable means attached at its proximate end to said sign carrying support structure and passing through said first pulley means and over said second pulley means through said longitudinal bore provided through said upper section and into a longitudinal bore provided through said base section; and, v. weight means attached to the distal end of said cable, whereby said weight is suspended in said bores provided through said upper section and said base section.

2. The device of claim 1, wherein said cable means is provided with a pre-determined weak point.

3. A sign carrying device, comprising:

(a) a base section mounted in a footing;

(b) an upper section connected to and extending from said base section;

(c) a first collar means mounted on and extending radially outwardly form the connection of said base and upper sections;

(d) a sign carrying support structure rotatably received on said first collar and having first and second frame members connected together so as to define proximate and distal ends with said frame members being increasingly divergent toward said distal ends thereof;

(e) a brace member attached to said upper section and extending outwardly therefrom;

(f) first pulley means rotatably mounted on said brace;

(g) second pulley means rotatably mounted inside a bore provided longitudinally through said upper section said second pulley means being positioned adjacent the top of said upper section;

(h) cable means attached at its proximate end to said sign carrying structure and passing through said first pulley means and over said second pulley means through said bore provided through said upper section and into a longitudinal bore provided through said base section; and, (i) counterweight means attached to the distal end of said cable, whereby said weight is suspended in said bores provided in said upper section and said base section.

4. The device of claim 3, wherein said cable means is provided with a pre-determined weak point.

5. The device of claim 3, wherein said base section is cylindrical.

6. The device of claim 3, wherein said upper section is cylindrical.

7. A sign carrying device, comprising:

(a) a base section mounted in a footing;

(b) an upper section connected to and extending from said base section;

(c) a first collar means mounted on and extending radially outward from the connection of said base and upper sections;

(d) a sign carrying support structure rotatably received on said first collar, comprising:

i. first and second frame members;

ii. a first horizontal support member connected to and extending from each frame member toward the other;

iii. a second collar means mounted to said first horizontal support member, thereby rigidly connecting said first and second frame members; and, iv. a second horizontal support member extending between and rigidly connected to each of said frame members;

(e) a brace member attached to said upper section and extending outwardly therefrom;

(f) first pulley means rotatably mounted on said brace member;

(g) second pulley means rotatably mounted inside a longitudinal bore provided through said upper section said second pulley means being positioned adjacent the top of said upper section;

(h) cable means attached at its proximate end to said sign carrying support structure and passing through said first pulley means and over said second pulley means through said bore provided through said upper section and into a longitudinal bore provided through said base section; and, (i) weight means attached to the distal end of said cable, whereby said weight is suspended in said bores provided through said upper section and said base section.

8. The device of claim 7, wherein said cable means is provided with a pre-determined weak point.

9. The device of claim 7, wherein said first and second frame members are connected together so as to have proximate and distal ends with the frame members being increasingly divergent toward said distal ends thereof.

10. The device of claim 7, wherein said base section is cylindrical and vertically mounted in said footing.

11. The device of claim 7, wherein said upper section is cylindrical and connected t said base section for axial alignment of said bores.

* * * * *